US008192850B2

(12) United States Patent
Brinley

(10) Patent No.: US 8,192,850 B2
(45) Date of Patent: Jun. 5, 2012

(54) COMBUSTION TURBINE COMPONENT HAVING BOND COATING AND ASSOCIATED METHODS

(75) Inventor: Erik R. Brinley, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 596 days.

(21) Appl. No.: 12/194,827

(22) Filed: Aug. 20, 2008

(65) Prior Publication Data

US 2010/0047614 A1 Feb. 25, 2010

(51) Int. Cl.
*B32B 9/00* (2006.01)
*B32B 15/00* (2006.01)
*B32B 19/00* (2006.01)

(52) U.S. Cl. ..... 428/698; 428/615

(58) Field of Classification Search ..... 428/698, 428/615

See application file for complete search history.

(56) References Cited

U.S. PATENT DOCUMENTS

| | | | | |
|---|---|---|---|---|
| 5,882,561 | A | 3/1999 | Barsoum et al. | |
| 6,123,997 | A * | 9/2000 | Schaeffer et al. | 427/383.7 |
| 6,485,844 | B1 | 11/2002 | Strangman et al. | |
| 6,916,529 | B2 | 7/2005 | Pabla et al. | |
| 7,087,266 | B2 | 8/2006 | Darolia et al. | |
| 7,341,427 | B2 | 3/2008 | Farmer et al. | |
| 7,354,651 | B2 | 4/2008 | Hazel et al. | |
| 2004/0105974 | A1 * | 6/2004 | Joelsson et al. | 428/336 |
| 2005/0112414 | A1 | 5/2005 | El-Raghy et al. | |
| 2005/0262965 | A1 * | 12/2005 | Palanisamy et al. | 75/236 |
| 2005/0287296 | A1 * | 12/2005 | Wadley et al. | 427/248.1 |
| 2006/0062912 | A1 | 3/2006 | Wortman et al. | |
| 2006/0093801 | A1 | 5/2006 | Darolia et al. | |
| 2006/0171813 | A1 | 8/2006 | Malak et al. | |
| 2006/0194688 | A1 * | 8/2006 | Sundberg et al. | 501/87 |
| 2007/0202003 | A1 | 8/2007 | Arrell et al. | |
| 2007/0224350 | A1 | 9/2007 | Schuisky | |
| 2008/0081172 | A1 | 4/2008 | Strock | |

OTHER PUBLICATIONS

Vuoristo et al., "Industrial and Research Activities in Thermal Spray Technology in the Nordic Region of Europe", Journal of Thermal Spray Technology, vol. 16, Issue 4, Dec. 2007, pp. 466-471.*

S.M. George Research Group, University of Colorada at Boulder, Fabrication and Properties of Nanolaminates, 2008.

Jenny Frodelius, Characterization of Ti2AIC Coatings Deposited with High Velocity Oxy-Fuel and Magnetron Sputtering Techniques, Licentiate Thesis No. 1357, 2008.

* cited by examiner

*Primary Examiner* — Jonathan Langman

(57) ABSTRACT

A combustion turbine component includes a combustion turbine component substrate and a bond coating on the combustion turbine component substrate. The bond coating may include $M_{n+1}AX_n$ (n=1,2,3) where M is selected from groups IIIB, IVB, VB, VIB, and VII of the periodic table of elements and mixtures thereof, where A is selected from groups IIIA, IVA, VA, and VIA of the periodic table of elements and mixtures thereof, and where X includes at least one of carbon and nitrogen. A thermal barrier coating may be on the bond coating.

9 Claims, 4 Drawing Sheets

COMBUSTION TURBINE COMPONENT HAVING BOND COATING AND ASSOCIATED METHODS

FIELD OF THE INVENTION

The present invention relates to the field of metallurgy, and, more particularly, to bond coatings and related methods.

BACKGROUND OF THE INVENTION

A hot section component of a combustion turbine is routinely subjected to rigorous mechanical loading conditions at high temperatures. A thermal barrier coating is typically formed on such a substrate of the combustion turbine component to insulate it from such large and prolonged heat loads.

The thermal barrier coating insulates the combustion turbine component substrate by using thermally insulating materials that can sustain an appreciable temperature difference between the substrate of the combustion turbine component and the thermal barrier coating surface. In doing so, the thermal barrier coating can allow for higher operating temperatures while limiting the thermal exposure of the combustion turbine component substrate, extending part life by reducing thermal fatigue.

Such a thermal barrier coating is typically formed on a bond coating, the bond coating being formed on the combustion turbine component substrate. The bond coating creates a bond between the thermal barrier coating and the combustion turbine component substrate.

As disclosed in U.S. Pat. No. 7,087,266 to Darolia et al., such a bond coating may be formed from a MCrAlY alloy, with M being selected from the group comprising Fe, Co, Ni, and mixtures thereof. This bond coating may be effective at maintaining the bond between the thermal barrier coating and the substrate up to about 1200° C. However, at temperatures greater than 1200° C., such a MCrAlY bond coating may become brittle and spallation (delamination and ejection) of the thermal barrier coating from the substrate may occur. Such spallation may lead to undesirable component wear and/or failure.

Some efforts at enhancing bond coating performance have focused on tailoring the composition of the combustion turbine component substrate itself to provide better compatibility with the bond coating and thus better bond coating performance. U.S. Pat. Pub. 2007/0202003 to Arrell et al., for example, discloses a variety of nickel based superalloy compositions with such an enhanced bond coating compatibility. However, in some applications, enhanced bond coating performance with combustion turbine component substrates formed from other alloy compositions may be desirable.

U.S. Pat. No. 6,485,844 to Strangman et al. discloses a bond coating for nickel based superalloy articles that is capable of withstanding high temperatures. The bond coating has a thickness of 0.4 μm to 1.2 μm and comprises, by percentage of weight, 5%-25% platinum, 5-16% aluminum, with a balance of nickel.

U.S. Pat. No. 7,354,651 to Hazel et al. discloses a silicide-containing bond coating for a silicon-containing combustion turbine component substrate. The bond coating is corrosion resistant and may withstand high temperatures. However, in some applications, a combustion turbine component substrate that does not contain silicon may be desirable.

Bond coatings formed from other compositions and having different properties, however, may be desirable. Moreover, bond coatings with increased oxidation resistance, increased thermal shock resistance, and high temperature particle stability are also desirable.

SUMMARY OF THE INVENTION

In view of the foregoing background, it is therefore an object of the present invention to provide a combustion turbine component having an enhanced bond coating and methods to make the combustion turbine component.

This and other objects, features, and advantages in accordance with the present invention are provided by a combustion turbine component comprising a combustion turbine component substrate and a bond coating on the combustion turbine component substrate. The bond coating may comprise $M_{n+1}AX_n$ (n=1,2,3) where M is selected from groups IIIB, IVB, VB, VIB, and VII of the periodic table of elements and mixtures thereof, where A is selected from groups IIIA, IVA, VA, and VIA of the periodic table of elements and mixtures thereof, and where X comprises at least one of carbon and nitrogen. There may be a thermal barrier coating on the bond coating.

Applicants theorize, without wishing to be bound, that this bond coating provides the combustion turbine component substrate with enhanced oxidation protection and allows for higher temperature operation because it becomes ductile, rather than brittle, above 1200° C. This helps to prevent spallation of the thermal barrier coating and increases the resistance of the combustion turbine component to damage caused by foreign material.

The bond coating may have a nanolaminate microstructure. Additionally or alternatively, the bond coating may have a thickness of less than 200 μm.

The coating may comprise at least one of $Ti_3SiC_2$, $Ti_2AlC$, $Cr_3AlC_2$, and $Cr_2AlC$. Furthermore, the thermal barrier coating may comprise a ceramic thermal barrier coating.

The combustion turbine component substrate may comprise QCrAlY, with Q being selected from the group comprising Fe, Co, Ni, and mixtures thereof, and Y being selected from the group comprising elements other than Fe, Co, Ni, and mixtures thereof.

A method aspect is directed to a method of making a combustion turbine component comprising providing a combustion turbine component substrate and thermally spraying a bond coating on the combustion turbine component substrate. The bond coating may comprise $M_{n+1}AX_n$ (n=1,2,3) where M is selected from groups IIIB, IVB, VB, VIB, and VII of the periodic table of elements and mixtures thereof where A is selected from groups IIIA, IVA, VA, and VIA of the periodic table of elements and mixtures thereof, and where X comprises at least one of carbon and nitrogen. In addition, a thermal barrier coating may be formed on the bond coating.

Thermally spraying may comprise at least one of high velocity oxygen fuel (HVOF) spraying, low velocity oxygen fuel (LVOF) spraying, plasma spraying, and flame spraying.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
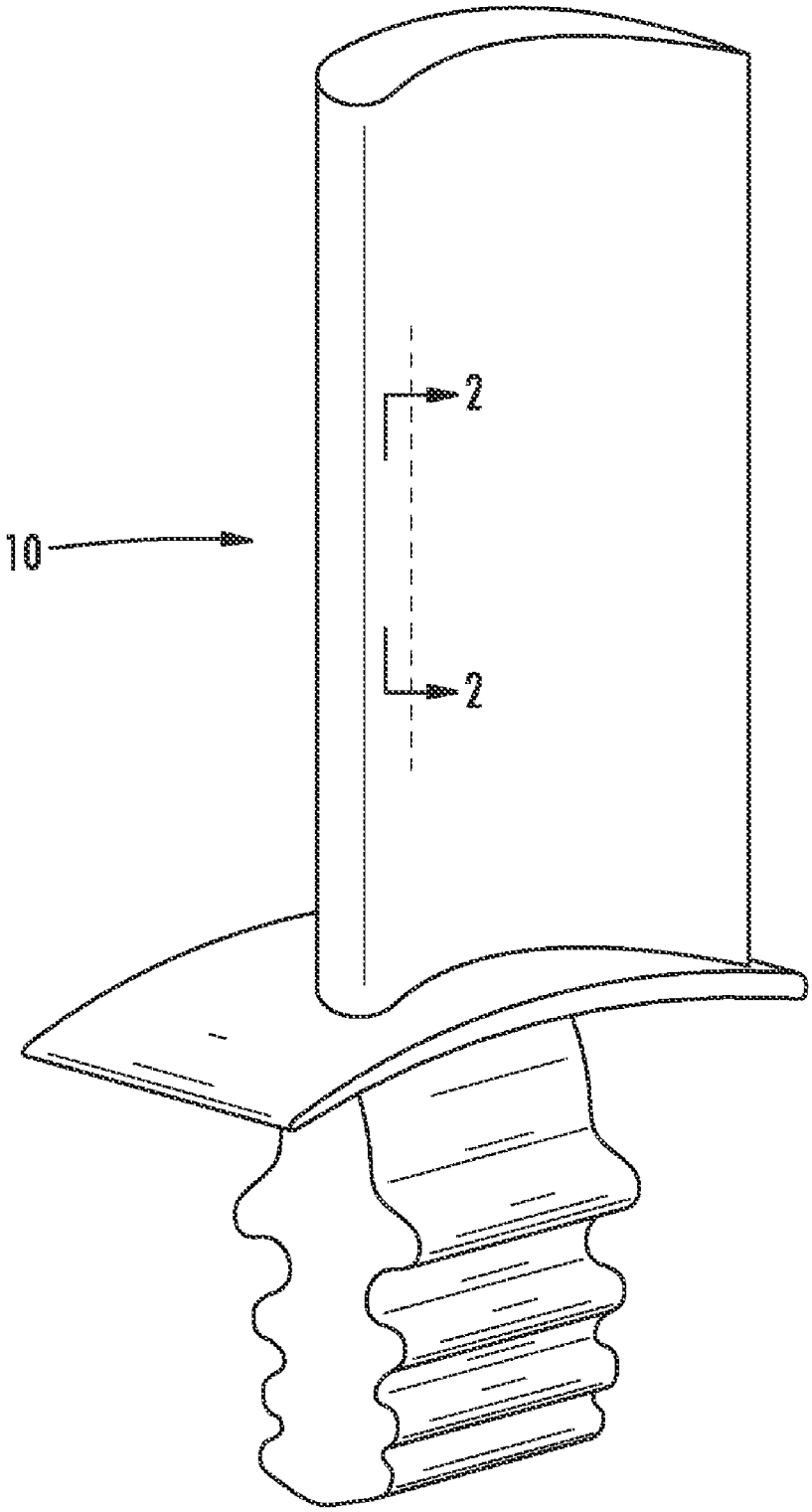
FIG. 1 is a front perspective view of a turbine blade having a MAX Phase bond coating formed thereon, in accordance the present invention.
Figure 2:
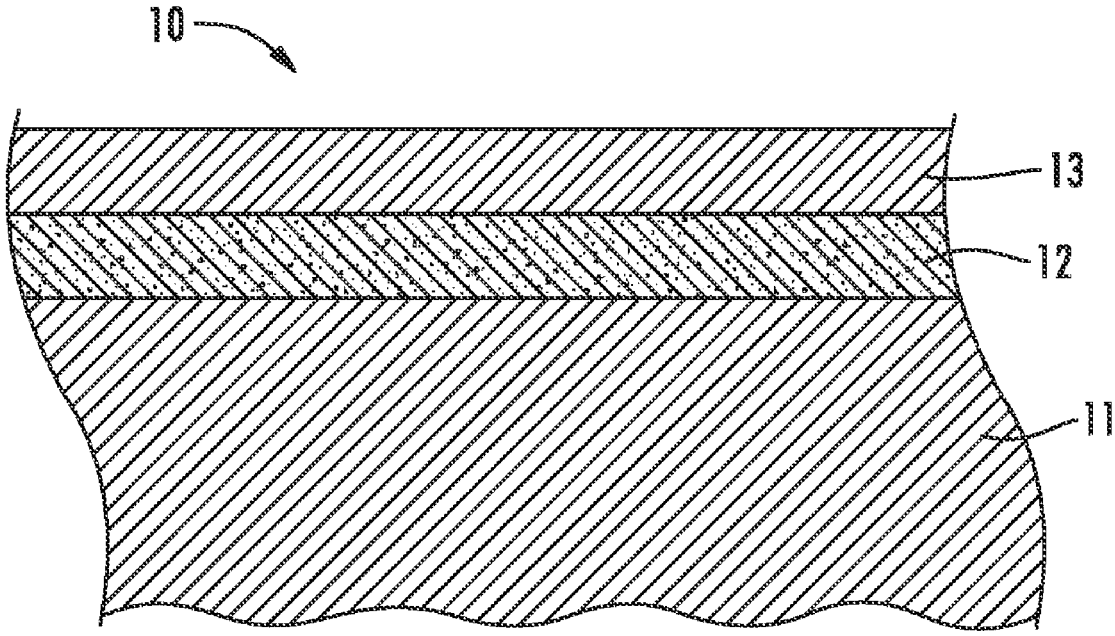
FIG. 2 is a greatly enlarged cross sectional view of the turbine blade taken along line 2-2 of FIG. 1.

Referring initially to FIGS. 1-2, a turbine blade 10 having a bond coating 12 formed in accordance with the present invention is now described. The turbine blade 10 comprises a combustion turbine component substrate 11. A bond coating 12 is formed on the combustion turbine component substrate 11. A thermal barrier coating 13 is illustratively formed on the bond coating 12. It will be readily understood by those of skill in the art that the bond coating 12 discussed above could be formed on any combustion turbine component 10, such as a blade or airfoil.

The combustion turbine component substrate 11 may comprise QCrAlY, with Q being selected from the group comprising Fe, Co, Ni, and mixtures thereof, and Y being selected from the group comprising elements other than Fe, Co, Ni, and mixtures thereof. For example, Y may comprise Ti, Ta, Mo, W, Re, Ru, O, Hf, Si, Y (yttrium), a lanthanide, a rare earth element, and combinations thereof.

Those of skill in the art will appreciate that the combustion turbine component substrate 11 may be constructed from other suitable alloys, for example superalloys. More details of exemplary superalloys from which the combustion turbine component substrate may be formed are found in copending applications COMBUSTION TURBINE COMPONENT HAVING RARE EARTH FeCrAl COATING AND ASSOCIATED METHODS U.S. patent application Ser. No. 12/194,596, COMBUSTION TURBINE COMPONENT HAVING RARE EARTH NiCrAl COATING AND ASSOCIATED METHODS U.S. patent application Ser. No. 12/194,582, COMBUSTION TURBINE COMPONENT HAVING RARE EARTH NiCoCrAl COATING AND ASSOCIATED METHODS U.S. patent application Ser. No. 12/184,567, and COMBUSTION TURBINE COMPONENT HAVING RARE EARTH CoNiCrAl COATING AND ASSOCIATED METHODS U.S. patent application Ser. No. 12/194,577, the entire disclosures of which are incorporated by reference herein.

The bond coating 12 comprises a ternary carbide or nitride. In particular, the bond coating 12 comprises a MAX Phase material $M_{n+1}AX_n$ (n=1,2,3) where M is selected from groups IIIB, IVB, VB, VIB, and VII of the periodic table of elements and mixtures thereof, where A is selected from groups IIIA, IVA, VA, and VIA of the periodic table of elements and mixtures thereof and where X comprises at least one of carbon and nitrogen.

The MAX Phases are a family of ternary carbides and nitrides that are an intermediate between a ceramic and a metal. It is to be understood that the bond coating 12 could comprise a plurality of such MAX Phase materials. For example, the bond coating 12 may comprise at least one of $Ti_3SiC_2$, $Ti_2AlC$, $Cr_3AlC_2$, and $Cr_2AlC$, which are exemplary MAX Phase materials.

The bond coating 12 may have a nanolaminate microstructure. Such a nanolaminate feature may be present regardless of how the bond coating is formed on the combustion turbine component substrate 11. This nanolaminate microstructure may have a grain thickness of 30 nm-50 nm. In addition, the bond coating 12 itself has a thickness of 200 μm, although in some applications the thickness of the bond coating may be greater than 200 μm.

The bond coating 12 is formed from MAX Phase materials because they have a high thermal shock resistance. In addition, MAX Phase materials have the ability to undergo reversible plasticity. As a general principle, crystalline solids exhibit irreversible plasticity; MAX Phase materials are an exception to this principle. For example, indentations made on $Ti_3SiC_2$ materials are not traceable due to the reversible plasticity for the MAX Phase materials. This plasticity advantageously increases the durability of the bond coating 12 and thus its ability to resist damage caused by foreign objects.

In addition, many of the MAX Phase materials are also elastically quite stiff. Some of the particularly stiff MAX compound-based include $Ti_3SiC_2$, $Ti_3AlC_2$, and $Ti_4AlN_3$. For example, at 320 GPa, $Ti_3SiC_2$ has a stiffness that is almost three times that of titanium metal, but the two materials have comparable densities of approximately 4.5 g/cm$^3$. This stiffness enhances the stability and durability of the bond coating 12.

Despite their high stiffness, the MAX Phase materials are relatively soft, particularly when compared with the chemically similar transition metal carbides. The softness and high stiffness properties make the MAX Phase materials readily machinable with relative ease. In fact, the MAX Phase materials are machinable with basic tools such as a manual hacksaw or high-speed tool steels, generally without need for lubrication or for cooling materials and processes. This may facilitate easy and cheaper fabrication of various combustion turbine components 10.

The thermal barrier coating 13 may comprise a ceramic thermal barrier coating. For example, an exemplary ceramic thermal barrier coating 13 is made of yttria stabilized zirconia (YSZ) which is desirable for having very low conductivity while remaining stable at the high operating temperatures typically seen in the hot sections of a combustion turbine. The thermal barrier coating 13, however, may be constructed from materials other than ceramics, as will be appreciated by those of skill in the art.

Over the lifetime of the combustion turbine component 10, some oxidation of the bond coating 12 may occur. In particular, in some embodiments, an aluminum oxide layer may form at the interface between the bond coating 12 and the thermal barrier coating 13. This aluminum oxide layer helps to prevent spallation of the thermal barrier coating 13 and, in addition, protects the underlying layers of the bond coating 12 from further oxidation. The coefficient of thermal expansion (CTE) of both aluminum oxide and the MAX Phase materials is similar, being $8\times10^{-6}$/K and $9\times10^{-6}$/K, respectively. In prior art thermal barrier coating systems, the CTE between the bond coating and the aluminum oxide layer may not match, leading to failure at the interface between the aluminum oxide layer and the bond coating. The CTE match between the bond coating 12 and the aluminum oxide layer that may form in certain embodiments of the present invention helps to reduce the chance of failure at this interface.

Figure 3:
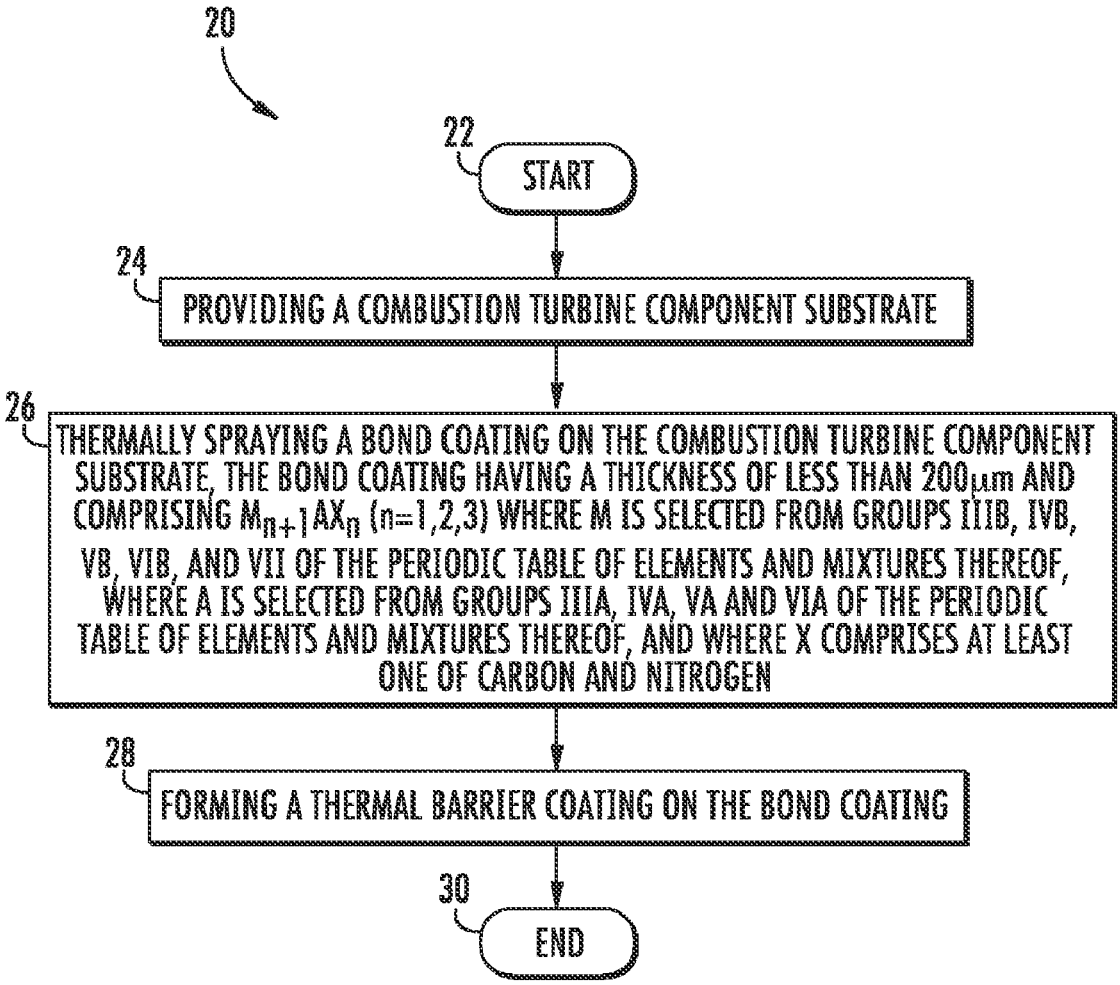
FIG. 3 is a flowchart of a method in accordance with the present invention.

An embodiment of a method of making a combustion turbine component is now described generally with reference to the flowchart 20 of FIG. 3. For clarity of explanation, reference numbers to the structural components described above are not used in the following description. After the start (Block 22), at Block 24, a combustion turbine component substrate is provided. Providing the combustion turbine component substrate may include formation by forging or casting, as will be readily understood by those skilled in the art.

At Block 26, a bond coating is thermally sprayed on the combustion turbine component substrate. The bond coating comprises $M_{n+1}AX_n$ (n=1,2,3) where M is selected from groups IIIB, IVB, VB, VIB, and VII of the periodic table of elements and mixtures thereof, where A is selected from groups IIIA, IVA, VA, and VIA of the periodic table of elements and mixtures thereof, and where X comprises at least one of carbon and nitrogen.

It is to be understood that any of a number of commercially available thermal spraying process may be employed for thermally spraying the bond coating. For example, plasma spraying, high velocity oxygen fuel (HVOF), low velocity oxygen fuel (HVOF), or flame spraying may be employed. At Block 28, a thermal barrier coating is formed on the bond coating by methods known to those of skill in the art. Block 30 indicates the end of this method embodiment.

Figure 4:
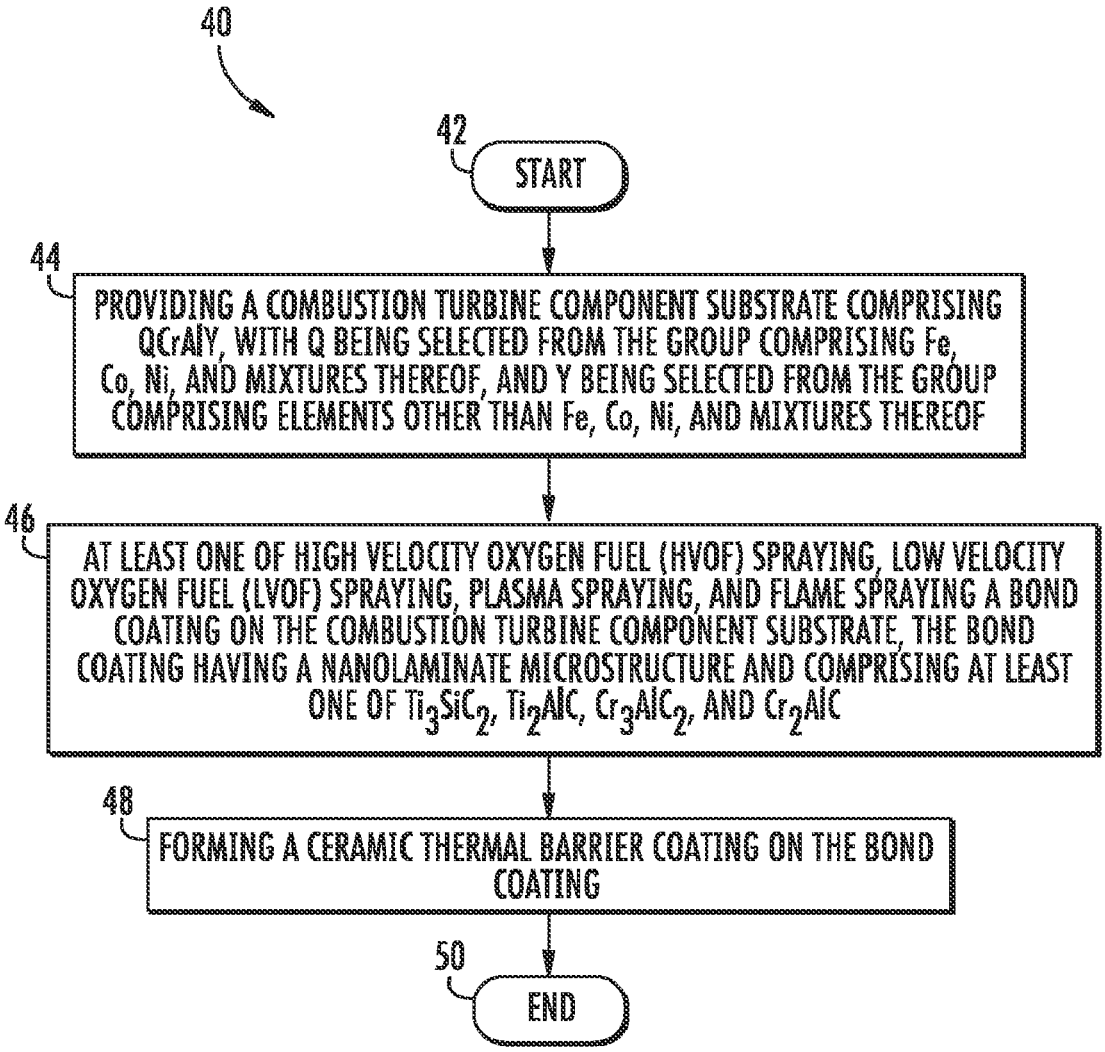
FIG. 4 is a flowchart of an alternative embodiment of a method in accordance with the present invention.

With reference to flow chart 40 of FIG. 4, an alternative embodiment of forming a combustion turbine component is now described. After the start (Block 42), at Block 44, a combustion turbine component is provided. The combustion turbine component comprises QCrAlY, with Q being selected from the group comprising Fe, Co, Ni, and mixtures thereof, and Y being selected from the group comprising elements other than Fe, Co, Ni, and mixtures thereof. For example, Y may comprise Ti, Ta, Mo, W, Re, Ru, O, Hf, Si, Y (yttrium), a lanthanide, a rare earth element, and combinations thereof.

At Block 46, a bond coating is at least one of high velocity oxygen fuel (HVOF), low velocity oxygen fuel (HVOF), plasma, or flame sprayed onto the combustion turbine component substrate. Those of skill in the art will appreciate that, alternatively, other methods of thermal spraying may be applied. The bond coating has a nanolaminate microstructure and comprises at least one of $Ti_3SiC_2$, $Ti_2AlC$, $Cr_3AlC_2$, and $Cr_2AlC$. At Block 48, a ceramic thermal barrier coating is formed on the bond coating. Block 50 indicates the end of this method embodiment.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A combustion turbine component comprising:

a combustion turbine component substrate;

a bond coating on said combustion turbine component substrate, said bond coating comprising $M_{n+1}AX_n$ (n=1, 2,3) where M comprises at least one of scandium, yttrium, lanthanum, actinium, rutherfordium, manganese, technetium, rhenium, tungsten, dubnium, seaborgium, and bohrium, where A is selected from groups IIIA, IVA, VA, and VIA of the periodic table of elements and mixtures thereof, and where X comprises at least one of carbon and nitrogen;

said bond coating further comprising $Cr_3AlC_2$; and a thermal barrier coating on said bond coating.

2. A combustion turbine component as in claim 1 wherein said bond coating has a nanolaminate microstructure.

3. A combustion turbine component as in Claim 1 wherein said bond coating has a thickness of less than 200 μm.

4. A combustion turbine component as in claim 1 wherein said bond coating further comprises at least one of $Ti_3SiC_2$, $Ti_2AlC$, and $Cr_2AlC$.

5. A combustion turbine component as in claim 1 wherein said thermal barrier coating comprises a ceramic thermal barrier coating.

6. A combustion turbine component as in Claim 1 wherein said combustion turbine component substrate comprises QCrAlY, with Q being selected from the group comprising Fe, Co, Ni, and mixtures thereof, and Y being selected from the group comprising elements other than Fe, Co, Ni, and mixtures thereof.

7. A combustion turbine component comprising:

a combustion turbine component substrate;

a bond coating on said combustion turbine component substrate, said bond coating comprising $Cr_3AlC_2$; and a ceramic thermal barrier coating on said bond coating.

8. A combustion turbine component as in claim 7 wherein said bond coating has a thickness of less than 200 μm.

9. A combustion turbine component as in claim 7 wherein said combustion turbine component substrate comprises QCrAlY, with Q being selected from the group comprising Fe, Co, Ni, and mixtures thereof, and Y being selected from the group comprising elements other than Fe, Co, Ni, and mixtures thereof.

* * * * *